US008317734B1

(12) United States Patent
Redfield

(10) Patent No.: US 8,317,734 B1
(45) Date of Patent: Nov. 27, 2012

(54) BONE CONDUCTION PAD

(75) Inventor: Randall Redfield, Denver, CO (US)

(73) Assignee: Integrated Listening Systems, LLC, Denver, CO (US)

( * ) Notice: Subject to any disclaimer, the term of this patent is extended or adjusted under 35 U.S.C. 154(b) by 648 days.

(21) Appl. No.: 12/456,625

(22) Filed: Jun. 19, 2009

(51) Int. Cl.
*A61H 1/00* (2006.01)
*H04R 25/00* (2006.01)

(52) U.S. Cl. ..... 601/47; 601/46; 601/57; 381/151

(58) Field of Classification Search ..... 601/57–59, 601/46–49; 381/423–424, 429, 151
See application file for complete search history.

(56) References Cited

U.S. PATENT DOCUMENTS 7,981,064 B2 * 7/2011 Oser et al. ..... 601/57
* cited by examiner

*Primary Examiner* — Patricia Bianco
*Assistant Examiner* — Ophelia Hawthorne
(74) *Attorney, Agent, or Firm* — McKenna Long & Aldridge LLP

(57) ABSTRACT

A device for providing vestibular and somatosensory stimulation through bone conduction of sound waves to skeletal bones is provided in the form of a pad that is applied to or wrapped around the individual in treatment, which is comfortable in use and may contain particulate filler material capable of providing bone conduction stimulation adjacent to the location of a bone conduction transducer and expand the sound conduction site over a larger area.

18 Claims, 2 Drawing Sheets

BONE CONDUCTION PAD

FIELD OF THE INVENTION

The present invention relates to devices and methods of providing stimulation of the vestibular and somatosensory systems of the human body through bone conduction utilizing one or more transducers to transmit sound frequencies through the skeletal frame.

BACKGROUND OF THE INVENTION

Hearing occurs in two ways: air conduction and bone conduction. Bone conduction delivery of sound occurs when the sound vibration is transmitted to the inner ear through the bones of the skeletal framework. This process stimulates the vestibular/cochlear and somatosensory systems as well as the central nervous system. Stimulating these physiological systems with the low frequencies carried by bone conduction tends to have a relaxing, stabilizing effect; it influences the ability for spatial equilibrium and balance, as well as the ability to modulate sensory input and to process information.

In addition to providing the sense of hearing, the vestibular system is the primary organ of equilibrium and plays a major role in the sensation of motion and spatial orientation; it also provides input to the nervous system, adjusting muscle activity, body posture and stabilizes the eyes during head movements. It is known that vestibular stimulation through air and bone conducted sound can enhance neurological development, and can be used in the treatment of autism, Asperger's, sensory processing disorder, and ADHD. It is widely recognized that the early detection of autism in children is fundamental to effective treatment. However, with very young children, because of the prior art device configurations, effective vestibular stimulation through sound is difficult.

Vestibular stimulation therapy of the prior art has consisted of the delivery of sound through headphones and the delivery of sound through headphones in conjunction with bone conduction delivery through a device attached to the headphones or the person's head. Although effective, the use of the headphones and bone conduction devices attached to a persons head may be uncomfortable and impractical in certain settings. Clearly with infants and small children such headphones and bone conduction devices are not practical; and in any application, such headphones and bone conduction devices can become unintentionally displaced, and therefore ineffective, through the movement of the individual. Further, such headphones and bone conduction devices cannot be applied to provide vestibular stimulation to a fetus in-utero.

Therefore, in light of the shortcomings and limitations of the prior art devices, it is an objective of the present invention to provide a bone conduction device for stimulation of the vestibular and somatosensory systems that may be utilized with young children and infants including pre-mature infants.

It is another object of the present invention to provide a bone conduction device for stimulation of the vestibular and somatosensory systems of a fetus in utero.

It is another object of the present invention to provide a bone conduction device for stimulation of the vestibular systems in individuals who receive little or no intrinsic vestibular stimulation as a result of their own limited or lack of movement.

It is another objective of the present invention to provide a bone conduction device for stimulation of the vestibular and somatosensory systems that remains effective even when the position of the transducer is displaced by the motion of the individual.

It is another objective of the present invention to provide a bone conduction device for stimulation of the vestibular and somatosensory systems that does not require head phones or attachment to the individuals head.

It is another objective of the present invention to provide a bone conduction device for stimulation of the vestibular and somatosensory systems that may be comfortably worn and provides stimulation during periods of physical activity and inactivity, including sleep.

DESCRIPTION OF THE INVENTION

The present invention provides a flexible pad which can be used as a bed surface, blanket or pillow through which sound waves can be transmitted by bone conduction to an individual to be treated. One or more transducers are embedded within a flexible pad that, depending upon its overall size, may be applied to or wrapped around the individual to be treated. The pad can be constructed in size from a few inches square to any larger size. The pad is applied to the individual so that its one or more transducers conduct sound waves to some part of the individual's skeletal frame such as the cranium, spine, hip or leg bones. The pad allows the individual to be treated while sleeping, sitting, swinging on a swing, or performing other quiet type activities. The pad is also suitable for providing stimulation to a fetus in utero by placing the pad upon the mother's body. Additionally, the pad may be utilized to provide treatment of premature infants; in such an application, the pad serves as a bedding surface with the head of the premature infant placed upon the area where a bone conduction transducer is located. The one or more bone conduction transducers are utilized to provide sound wave bone conduction rich in low frequencies, primarily between 100 and 1,000 Hz.

The sound source to be transmitted through the one or more transducers is typically supplied by a tape player, CD player, or MP3 player. The sound selected for transmission may include full spectrum music, music rich in low frequencies, music filtered to remove higher frequency content, a recorded heartbeat and other rhythmic sounds which have a soothing and stabilizing effect.

The flexible bone conduction pad comprises a cover, typically of waterproof textile fabric, which encloses the entire pad. One or more bone conduction transducers are located within a recess formed within a sheet of foam padding or textile batting to provide a comfortable transition surrounding the transducer. Electrical leads extend from the one or more transducers to a pocket at the periphery of the pad where an electrical connector is provided for connection to the sound source contained within the pocket. As the sound source, transducer and leads are all contained within the cover of the pad, an individual being treated cannot become entangled within the leads from the sound source to the transducer.

In an alternate embodiment of the foregoing invention additional filler material is utilized, in place of, or in addition to the sheet of foam padding or textile batting. The additional filler material is comprised of particles of firm material capable of transmission of low frequency sound waves in the range of 100 to 4,000 Hz. Although various shapes and materials may be employed, spherical glass beads of about ⅛ inch have been found to be well suited. The particles of firm material are distributed throughout a section of the pad and enclosed within a bag containing a transducer in at least a density that provides contact between adjacent particles and contact between a transducer and adjacent particles. The particles thereby provide a means of bone conduction adjacent to the location of a transducer and expand the sound conduction site over a larger area.

The bone conduction pad of the present invention has been found to have application of particular import in the treatment of infants and premature infants. In application the infant is placed upon the pad with its head located upon a transducer site. Sound that is rich in low frequencies, primarily between 100 and 1,000 Hz is selected, although the overall range of sound frequencies may be between 100 and 4,000 Hz. Classical music pieces such as Mozart, Bach, cello pieces and female Gregorian chants have been employed. Such pieces are filtered to remove higher frequency content that has an agitating effect upon infants and premature infants. Additionally, the sound is blended with a recorded heartbeat which provides rhythm and has a claming effect.

The foregoing embodiments of the present invention were developed to provide bone conduction delivery of sounds in the absence of air conduction; however, it should be recognized that the device could allow for a splitter to be employed at the music source to provide simultaneous air conduction with headphones or the like. Such simultaneous air conduction would allow combined air conduction and bone conduction stimulation for the individual to be treated or allow a mother to monitor the sounds conducted to her fetus in utero.

DETAILED DESCRIPTION OF THE DRAWINGS

Figure 1:
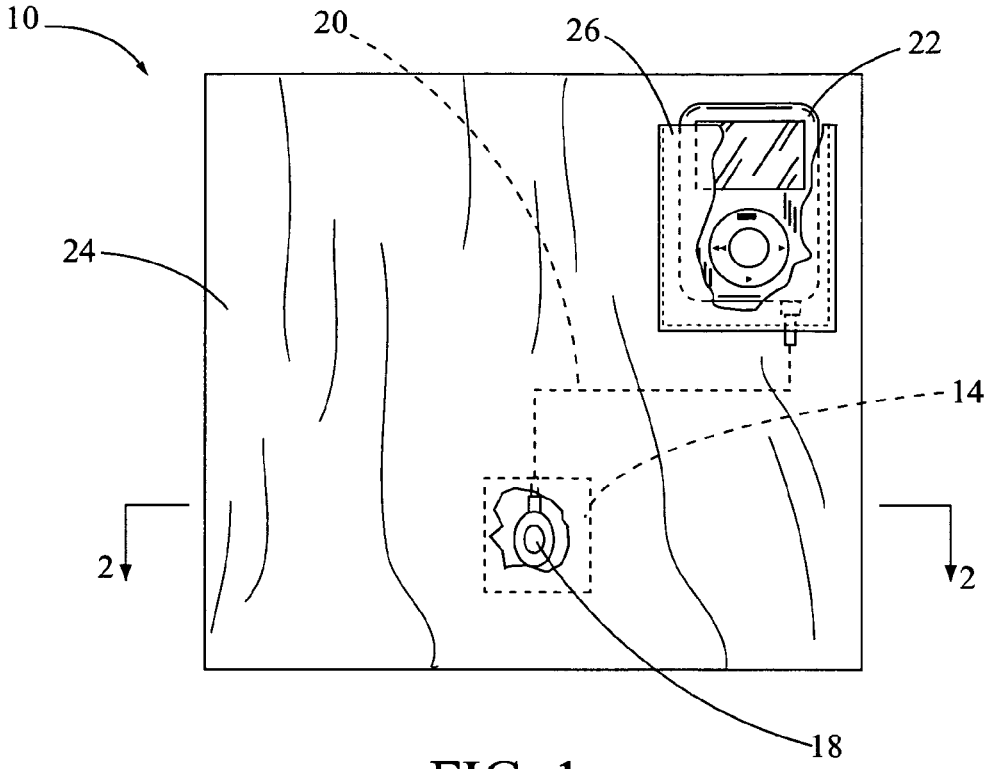
FIG. 1 is a plan view of a bone conduction pad of the present invention.
Figure 2:
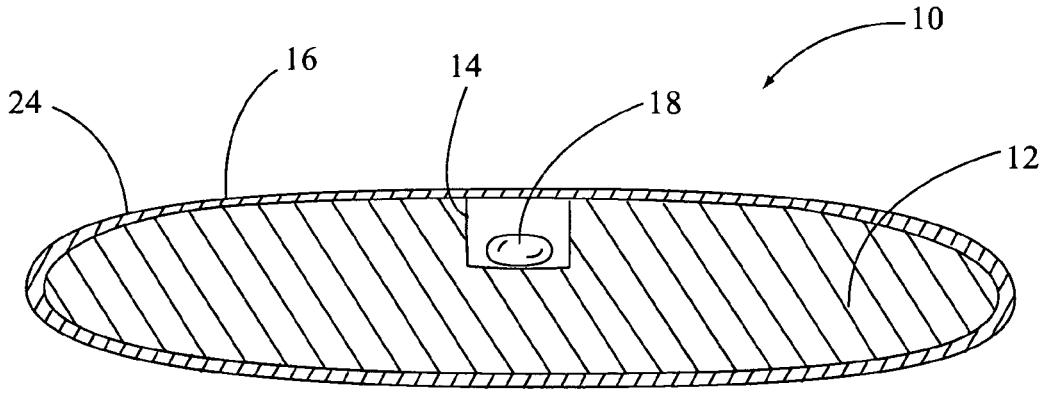
FIG. 2 a cross sectional view of a bone conduction pad of FIG. 1.

FIGS. 1 and 2 illustrate the bone conduction pad 10 of the present invention. Bone conduction pad 10 is constructed from a flexible sheet of padding 12 having a recess 14 formed in its upper face 16. The flexible sheet of padding 12 is typically made of foam or textile batting so that an individual being treated may comfortably lie upon or apply the bone conduction pad 10 to their body. Within recess 14 is located a bone conduction transducer 18. Bone conduction transducer 18 is particularly selected so that it is capable of emitting low frequency sound waves between 100 and 4,000 Hz. Bone conduction transducer 18 is electrically connected through electrical leads 20 to a sound source 22. In practice, the sound source 22 is typically a tape player CD player or MP3 player, however other devices capable of producing the appropriate low frequency sound signals may be employed. A cover 24 typically of waterproof textile material encloses the flexible sheet of padding 12, bone conduction transducer 18, electrical leads 20 and sound source 22. Cover 24 is constructed with a pocket 26 at its periphery to secure sound source 22.

In application, the bone conduction pad 10 is positioned upon or under an individual so that bone conduction transducer 18 is able to emit low frequency waves to the skeletal frame of the individual. The signals provided to transducer 18 from sound source 22 are particularly selected, based upon the condition of the individual being treated, to provide sound waves that result in a particular therapeutic effect.

Figure 3:
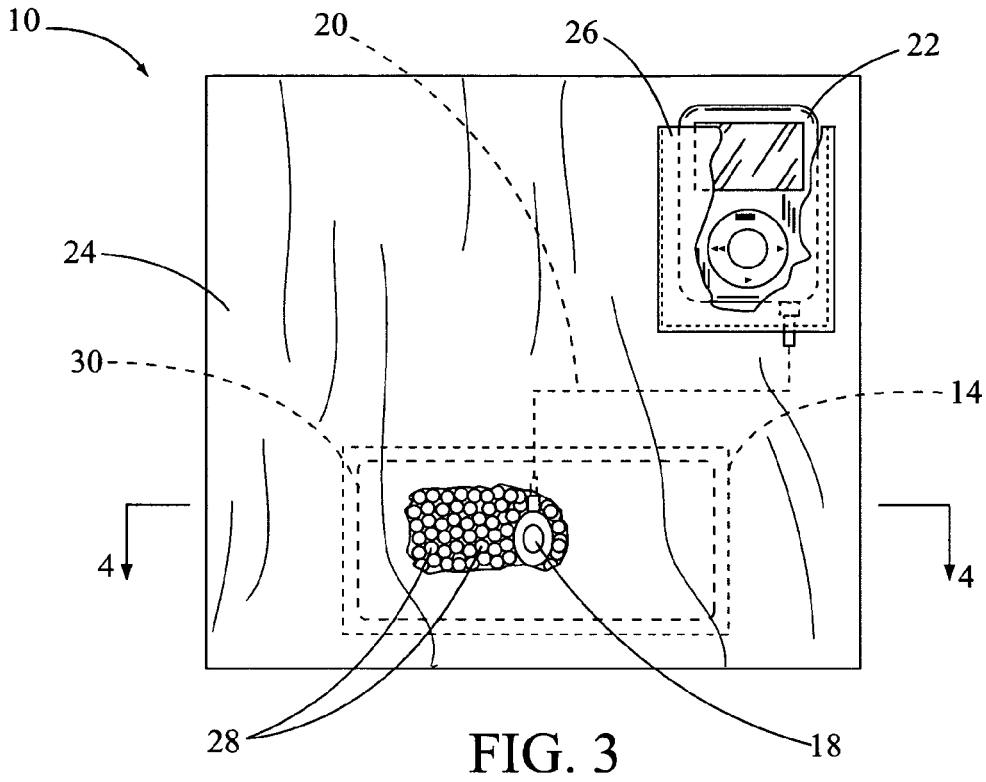
FIG. 3 is a plan view of an alternate embodiment of a bone conduction pad of the present invention.
Figure 4:
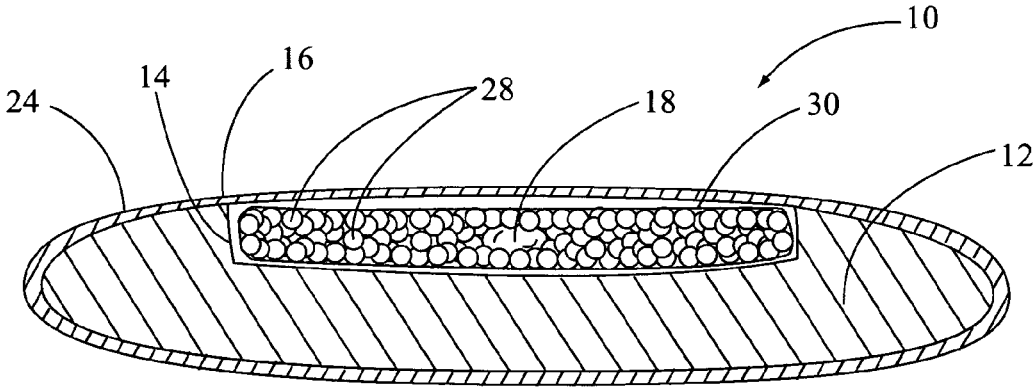
FIG. 4 is a cross sectional view of the alternate embodiment of the bone conduction pad of FIG. 3.

FIGS. 3 and 4 illustrate an alternate embodiment of the bone conduction pad 10 of the present invention. Bone conduction pad 10 of this alternate embodiment is constructed in the same fashion as the embodiment depicted in FIGS. 1 and 2, with the exception that transducer 18 is placed within and contacts a bed of particulate matter 28 that is enclosed within a flexible membrane 30. The recess 14 within the flexible sheet of padding 12 of this alternate embodiment is appropriately sized to accommodate transducer 18, and particulate matter 28.

In application of this alternate embodiment of the bone conduction pad 10, the area for bone conduction of low frequency waves between the bone conduction transducer 18 and the skeletal frame of the individual being treated is greatly increased. As the bed of particulate matter 28 surrounding the bone conduction transducer 18 transmits the waves emitted from the bone conduction transducer 18, the area of effective transmission is greatly increased; as a result, placement of the bone conduction pad 10 need not be as precise and remains effective despite activity that may unintentionally displace the bone conduction pad 10.

What is claimed is:

1. A vestibular/cochlear stimulation pad comprising:

a flexible sheet of padding having an upper face;

a cover fully enclosing the flexible sheet of padding;

a bone conduction transducer in direct contact with the cover, between said upper face and the cover, the bone conduction transducer configured to emit sound waves with frequencies between 100 and 4,000 Hz to stimulate the vestibular/cochlear apparatus of a human through bone conduction; and a sound source electrically connected to and transmitting signals to said bone conduction transducer, wherein said flexible sheet of padding and said cover are configured so that said bone conduction transducer is capable of communicating the sound waves to the skeletal frame of a human.

2. The vestibular/cochlear stimulation pad of claim 1, further comprising:

a bed of particles in contact with said bone conduction transducer that transmit sound waves within the frequency range between 100 and 4,000 Hz.

3. The vestibular/cochlear stimulation pad of claim 2, wherein said particles of said bed of particles are spherical in shape.

4. The vestibular/cochlear stimulation pad of claim 1, wherein the cover is made of a textile.

5. The vestibular/cochlear stimulation pad of claim 4, wherein the textile is a waterproof fabric.

6. The vestibular/cochlear stimulation pad of claim 1, wherein said signals from said sound source cause said bone conduction transducer to emit music rich in low frequencies.

7. The vestibular/cochlear stimulation pad of claim 1, wherein said signals from said sound source cause said bone conduction transducer to emit music with high frequencies filtered out.

8. The vestibular/cochlear stimulation pad of claim 1, wherein said signals from said sound source cause said bone conduction transducer to emit the low frequency sound of a heartbeat.

9. The vestibular/cochlear stimulation pad of claim 1, wherein said signals from said sound source cause said bone conduction transducer to emit a blend of music rich in low frequencies and the low frequency sound of a heartbeat.

10. The vestibular/cochlear stimulation pad of claim 1, wherein the upper face of the flexible sheet of padding is configured to support a human cranium.

11. The vestibular/cochlear stimulation pad of claim 1, further comprising:

a second bone conduction transducer in contact with said cover, between said upper face and said cover, said second bone conduction transducer configured to emit sound waves with frequencies between 100 and 4,000 Hz and to stimulate the vestibular/cochlear apparatus of a human through bone conduction.

12. The vestibular/cochlear stimulation pad of claim 1, wherein the sound source is located in a pocket on a periphery of the flexible sheet of padding.

13. The vestibular/cochlear stimulation pad of claim 1, wherein the bone conduction transducer is located within a recess formed in the flexible sheet of padding.

14. The vestibular/cochlear stimulation pad of claim 1, wherein the transducer, sound source, and electrical leads connecting the transducer and the sound source are contained within the cover.

15. The vestibular/cochlear stimulation pad of claim 1, wherein the sound source is located in a pocket on a periphery of the cover.

16. The vestibular/cochlear stimulation pad of claim 1, further comprising:

a plurality of bone conduction transducers located on said upper face of the flexible sheet of padding.

17. The vestibular/cochlear stimulation pad of claim 1, wherein said upper face is recessed surface.

18. A method of using the vestibular/cochlear stimulation pad of claim 1, wherein the vestibular/cochlear stimulation pad is configured in the form of a pillow.

* * * * *